US006382312B2

(12) United States Patent
Avequin et al.

(10) Patent No.: US 6,382,312 B2
(45) Date of Patent: May 7, 2002

(54) HEAT-EXCHANGE MODULE, FOR A MOTOR VEHICLE IN PARTICULAR

(75) Inventors: Stephane Avequin, Versailles; Gérard Gille, Paray Vieille Poste, both of (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/770,683

(22) Filed: Jan. 29, 2001

(30) Foreign Application Priority Data

Jan. 28, 2000 (FR) ..... 00 01137
Aug. 4, 2000 (FR) ..... 00 10347

(51) Int. Cl.[7] ..... F28F 9/007
(52) U.S. Cl. ..... 165/140; 165/67; 180/68.4
(58) Field of Search ..... 165/67, 140, 76, 165/149; 180/68.4; 29/890.03

(56) References Cited

U.S. PATENT DOCUMENTS 3,757,856 A * 9/1973 Kun ..... 165/166
3,938,587 A 2/1976 Vian
5,069,275 A * 12/1991 Suzuki et al. ..... 165/67
5,487,422 A * 1/1996 Bertva ..... 165/67
5,725,047 A 3/1998 Lopez
5,743,328 A 4/1998 Sasaki et al.
5,791,402 A * 8/1998 Dumetz ..... 165/67
6,223,812 B1 * 5/2001 Gough ..... 165/173

FOREIGN PATENT DOCUMENTS

| | | |
|---|---|---|
| DE | 2300080 | 7/1974 |
| DE | 19628523 | 11/1997 |
| FR | 1521637 | 8/1968 |
| FR | 2549945 | 2/1985 |

* cited by examiner

*Primary Examiner*—Allen Flanigan
(74) *Attorney, Agent, or Firm*—Liniak, Berenato, Longacre & White

(57) ABSTRACT

A heat-exchange module has a main exchanger and at least one secondary exchanger, each including a body with fluid-circulation tubes and with a clipping device for fixing the secondary exchanger onto the main exchanger so that the same airflow can pass through the bodies of the exchangers. The clipping device has at least one comb-shaped component including a fitting device for fitting onto a first of the exchangers, and at least one first row of teeth having between them, pair by pair, a gap of a shape corresponding to the cross section of the fluid-circulation tubes of the second of the exchangers, so as to clip the body of this second exchanger onto the comb-shaped component.

14 Claims, 5 Drawing Sheets

HEAT-EXCHANGE MODULE, FOR A MOTOR VEHICLE IN PARTICULAR

FIELD OF THE INVENTION

The present invention relates to a heat-exchange module comprising a main exchanger and at least one secondary exchanger each including a body provided with fluid-circulation tubes and with clipping means for fixing the secondary exchanger onto the main exchanger in such a way that the same airflow can pass through the respective bodies of the said exchangers.

BACKGROUND OF THE INVENTION

Such exchangers are generally presented in the form of a body provided with fluid-circulation tubes and with fins for heat exchange with the outside environment. This body is arranged between two manifolds which distribute the fluid into the circulation tubes.

It is known to assemble one or more secondary exchangers onto a main exchanger, such as a radiator for cooling a motor-vehicle engine, so as to constitute an assembly, also called module, ready to be installed into the vehicle. This secondary exchanger most often consists of an engine-supercharging air cooler or of an air-conditioning condenser.

The assembling of the secondary exchanger or exchangers onto the main exchanger is achieved generally by means of lugs integral with the secondary exchanger and of screws inserted into the manifolds of the main exchanger. Systems have also been proposed for assembly by interlocking or clipping of the manifolds.

These known assemblies of primary and secondary exchangers exhibit the drawback of requiring operations which are expensive in terms of time and of tooling.

Moreover, the linking elements between the main and secondary exchangers take up a certain amount of space which impairs the compactness of the module. This is because the manifolds are of a substantial thickness. The thickness of the module is therefore not conditioned by the sum of the thicknesses of the exchanger bodies, that is to say of the assemblies of tubes, but by the sum of the thicknesses of the manifolds, which are substantially greater.

Moreover, these linking elements take up a certain amount of transverse space, and therefore do not make it possible to dispose of the same exchange surface area for the main and secondary exchangers.

The present invention aims to remedy these drawbacks.

More particularly, the object of the invention is to furnish a heat-exchange module the production of which, and especially the fitting operations of which, are as simple as possible.

A further object of the invention is to provide such a heat-exchange module which, as far as possible, includes no assembling pieces between the main and secondary exchangers.

The invention further envisages providing a method of producing a heat-exchange module requiring no assembly operations or, where that is impossible, including a minimum number.

A further object of the invention is to provide such a heat-exchange module of lesser thickness than those of the prior art.

A further object of the invention is to provide a heat-exchange module exhibiting enhanced heat-exchange characteristics.

SUMMARY OF THE INVENTION

According to the present invention there is provided a heat-exchange module comprising a main exchanger and at least one secondary exchanger, each including a body provided with fluid-circulation tubes and with a clipping device for fixing the secondary exchanger onto the main exchanger in such a way that the same airflow can pass through the respective bodies of the said exchangers, wherein the said clipping device comprise at least one comb-shaped component including:

a fitting device for fitting onto a first of the said exchangers, and at least one first row of teeth exhibiting between them, pair by pair, a gap of a shape corresponding substantially to the cross section of the fluid-circulation tubes of the second of the said exchangers, so as to clip the body of this second exchanger onto the said comb-shaped component in order to fix it to the first exchanger.

The exchangers are therefore assembled by their body, by way of their tubes and of the comb-shaped components.

This results in a simplification of the fitting of the heat-exchange module.

The module may moreover exhibit smaller dimensions. This is because the comb-shaped components can be situated entirely within the space between the bodies and, in this case, not overlap onto the cross section of the exchangers. Moreover, the bodies can also be as close together as is desired.

This therefore also results in a lesser thickness for the module, and the possibility of having available the maximum exchange surface area for each exchanger.

In one particular embodiment, the said means for fitting the comb-shaped component onto the first of the said exchangers comprise a second row of teeth exhibiting between them, pair by pair, a gap of a shape corresponding substantially to the cross section of the fluid-circulation tubes of the first of the said exchangers, so as to clip the said comb-shaped component onto the body of the first exchanger.

In another particular embodiment, the said means for fitting the comb-shaped component onto the first of the said exchangers comprise a set of holes into which are engaged the fluid-circulation tubes of the first exchanger.

The said comb-shaped component may comprise a support strip and teeth substantially in the plane of the strip, the plane of this component lying substantially perpendicular to the planes of the bodies of the exchangers.

In a variant, the said comb-shaped component may comprise a support strip and teeth in a plane substantially perpendicular to the plane of the strip, the plane of the strip lying substantially parallel to the planes of the bodies of the exchangers.

More particularly, the heat-exchange module according to the invention may comprise at least two comb-shaped components, the said components belonging to two sides of a fitting frame configured to accommodate the said heat exchangers by means of the comb-shaped components.

Yet more particularly, the heat-exchange module according to the invention may include a tubular frame with two comb-shaped components, the support strips of which are arranged inside the frame, along two opposite sides thereof, in a central part of these sides in the axial sense.

In one particular embodiment, the comb-shaped component has a stepped feature, preferably substantially parallel to the plane of the exchangers, between the means for fitting onto the first exchanger and the first row of teeth.

The stepped feature may extend over the entire length of the comb-shaped component or only at the ends thereof.

This configuration makes it possible to assemble exchangers of different dimensions.

A further object of the invention is a method of producing a heat-exchange module comprising a main exchanger and at least one secondary exchanger each including a body provided with fluid-circulation tubes, and clipping means for fixing the secondary exchanger onto the main exchanger in such a way that the same airflow can pass through the respective bodies of the said exchangers, this method comprising the stages consisting in:

producing the said exchangers, producing at least one comb-shaped component including means for fitting onto a first of the said exchangers, and at least one first row of teeth featuring between them, pair by pair, a gap of a shape corresponding substantially to the cross section of the fluid-circulation tubes of the second of the said exchangers, fitting the said comb-shaped component onto the first exchanger, and clipping the body of the second exchanger onto the said comb-shaped component.

In a first implementation of the method according to the invention, the said comb-shaped component is mounted on the first exchanger when the latter is being produced.

In another implementation, the said comb-shaped component is clipped onto the body of the first exchanger after the latter has been produced.

BRIEF DESCRIPTION OF THE DRAWINGS

Particular embodiments of the invention will now be described, by way of non-limiting example, by reference to the diagrammatic drawings attached, in which.

DESCRIPTION OF THE PREFERRED EMBODIMENTS

Figure 1:
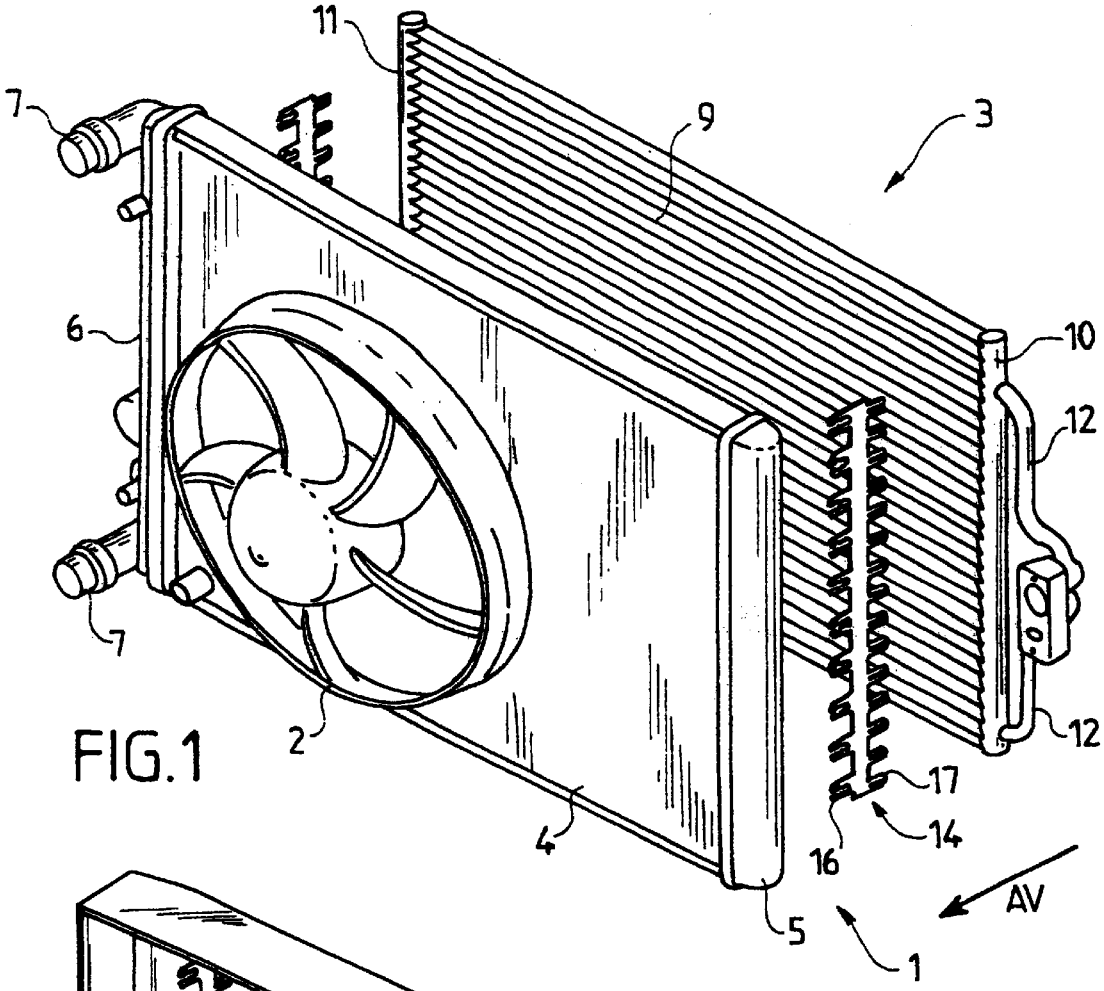
FIG. 1 is a view in exploded perspective of a heat-exchange module according to a first embodiment of the invention.

A heat-exchange module can be seen in FIG. 1, comprising two heat exchangers, namely a radiator 1 for cooling a motor-vehicle engine, equipped with its motor-driven fan unit 2, and an air-conditioning condenser 3.

The radiator 1 consists, in a known way, of a body 4 mounted between two manifolds 5 and 6, the manifold 6 being provided with cooling-fluid inlet and outlet pipes 7.

The body 4 is produced from a bank of horizontal fluid-circulation tubes 8 (FIG. 4), which are not represented individually in FIG. 1. These tubes here are circular-section tubes distributed into two layers perpendicular to the forward direction AV of the vehicle.

The condenser 3 also consists of a body 9 mounted between two manifolds 10 and 11, the manifold 10 being equipped with fluid inlet and outlet pipes 12.

Figure 4:
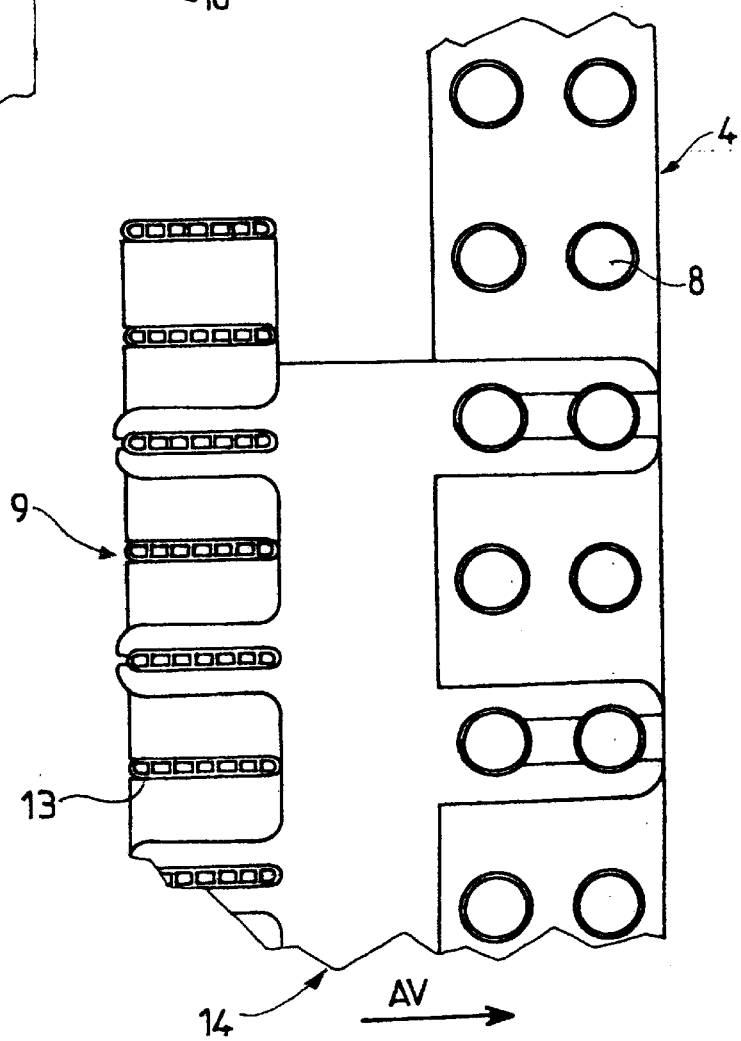
FIG. 4 is a view of this component mounted on the module.

The body 9 is produced from a bank of horizontal fluid-circulation tubes 13 (FIG. 4). The tubes 13 are flat tubes, partitioned internally, also called multichannel tubes, the plane of which is arranged parallel to the forward direction AV of the vehicle. These tubes 13 are distributed into a single layer perpendicular to the direction AV.

Figure 3:
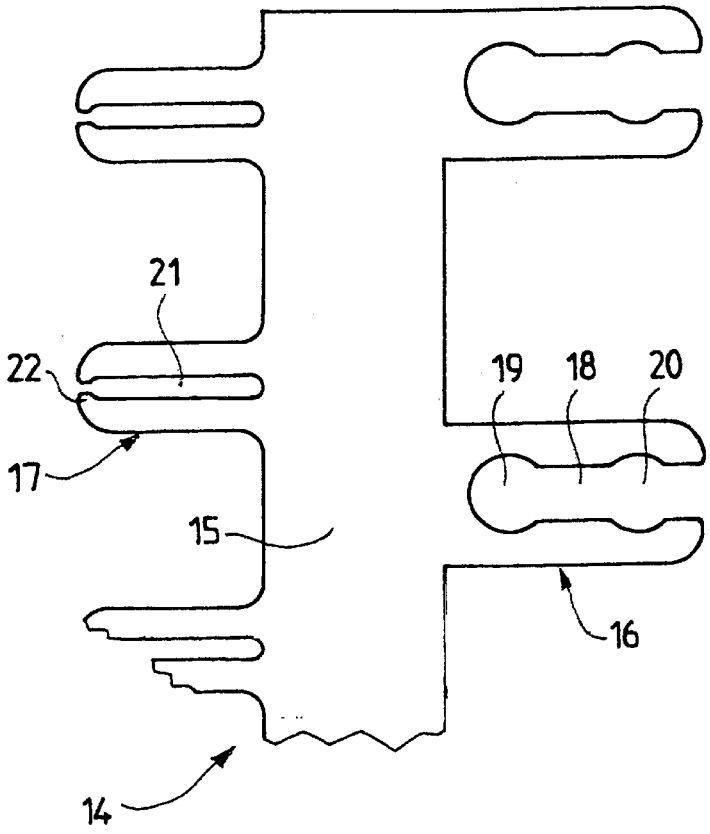
FIG. 3 is a side view of a comb-shaped component of the heat-exchange module of FIG. 1.

It will be seen below that the heat exchangers 1 and 3 are assembled by their body 4 and 9 respectively, by way of two comb-shaped components 14, a segment of which is represented in detail in FIG. 3.

Each component 14 possesses a generally elongate flat shape, with a solid central strip 15 equipped, along each of its long sides, with a row of pairs of teeth, 16, 17 respectively, thus forming two opposite combs in the plane of the strip 15.

The pairs of teeth 16 are spaced at the transverse pitch of the tubes 8, and form, between these teeth, a slot 18 with a width slightly less than the diameter of the tubes 8. This slot therefore includes two widened regions, one, 19, at the back of the slot, and the other, 20, close to the edge of the slot.

The widened regions 19 and 20 have a generally circular shape with a diameter substantially equal to that of the tubes 8. Their centers are spaced along the slot 18 by a distance substantially equal to the distance separating the two layers of tubes 8.

The pairs of teeth 17 are spaced at the transverse pitch of the tubes 13, and form, between these teeth, a slot 21 with a depth substantially equal to the width of the tubes 13, and with a width substantially equal to the thickness of these tubes.

Each slot 21 has a rounded back and is partially closed by a retaining hook 22 projecting from the extremity of each tooth towards the inside of the slot.

The components 14 are produced, for example, from plastic, and are cut to order, depending on the height of the heat-exchange module. As shown in FIG. 4, each component is clipped, in the first place, for example, onto the tubes 8 of the exchanger 1 by its teeth 16, then the tubes 13 of the exchanger 3 are clipped onto the teeth 17 of the component 14 so as to assemble the module.

The plane of each component 14 is therefore, in the present embodiment, substantially perpendicular to the planes of the layers of tubes 8 and 13. The strips 15 of each component 14 fulfil the function of lateral sealing for the flow of air between the two exchangers.

Figure 2:
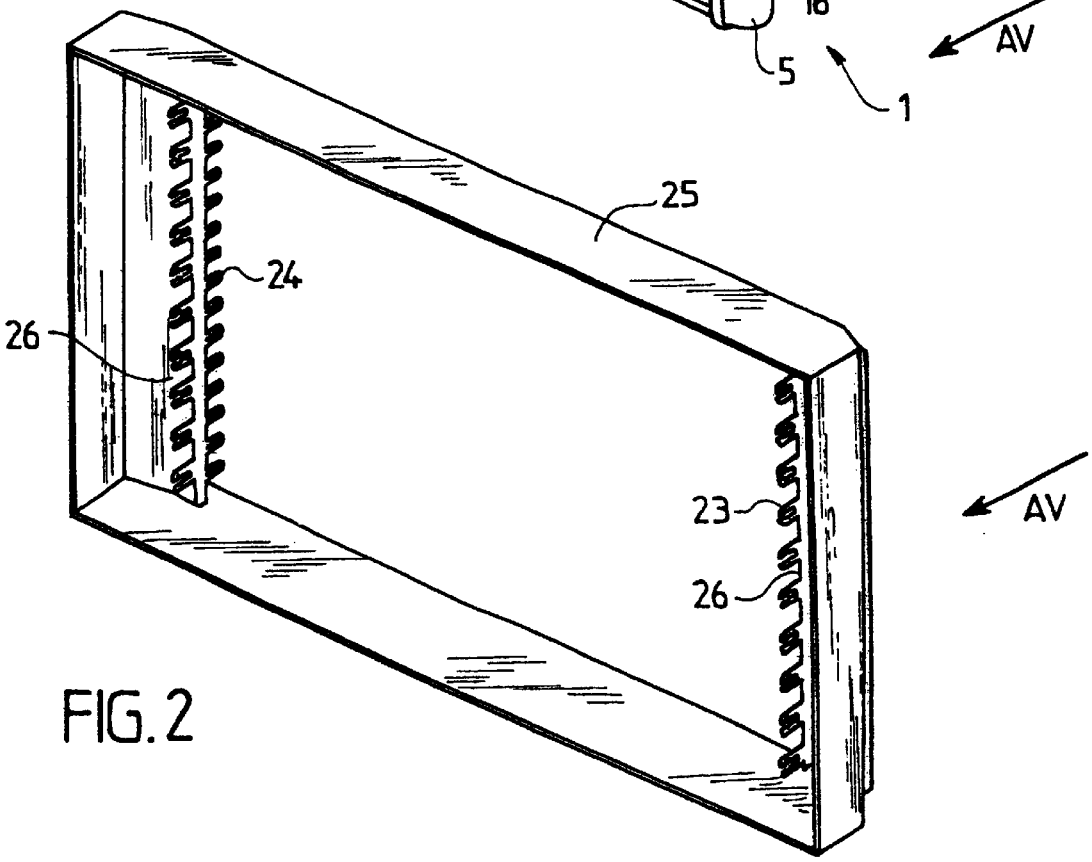
FIG. 2 is a perspective view of a heat-exchange module frame according to a second embodiment of the invention.

FIG. 2 presents a variant in which the clipping teeth 23 for clipping the exchanger 1, and 24 for clipping the exchanger 3, are mounted on a frame 25.

The frame 25, in the direction of the arrow AV, exhibits a shape which is generally tubular with a rectangular cross section, of dimensions slightly greater than the dimensions, in plan view, of the heat exchangers 1 and 3.

In the axially central region of the frame 25, two strips 26 are fixed to the opposite vertical sides of this frame, projecting towards the inside thereof, and thus substantially perpendicular to the direction of the arrow AV. The clipping teeth 23 and 24 are arranged along the inside edge of the strips 26, perpendicularly to the plane of these strips, consequently projecting in the direction of the arrow AV.

The shape and the pitch of the teeth 23 are identical to those of the teeth 16, such that the shape and the pitch of the teeth 24 are identical to those of the teeth 17.

The heat-exchange module is then assembled by successively clipping the tubes 8 of the exchanger 1 and 13 of the exchanger 3 onto the frame 25, by means of the teeth 23 and 24 respectively.

In this case, the lateral sealing between the two exchangers is provided by the frame 25 which forms an airflow duct in which the two exchangers are interposed.

The tubular frame 25 may feature, axially, that is to say in the direction of the arrow AV, a dimension substantially equal to the thickness of the module, which it therefore almost entirely envelopes.

Figure 5:
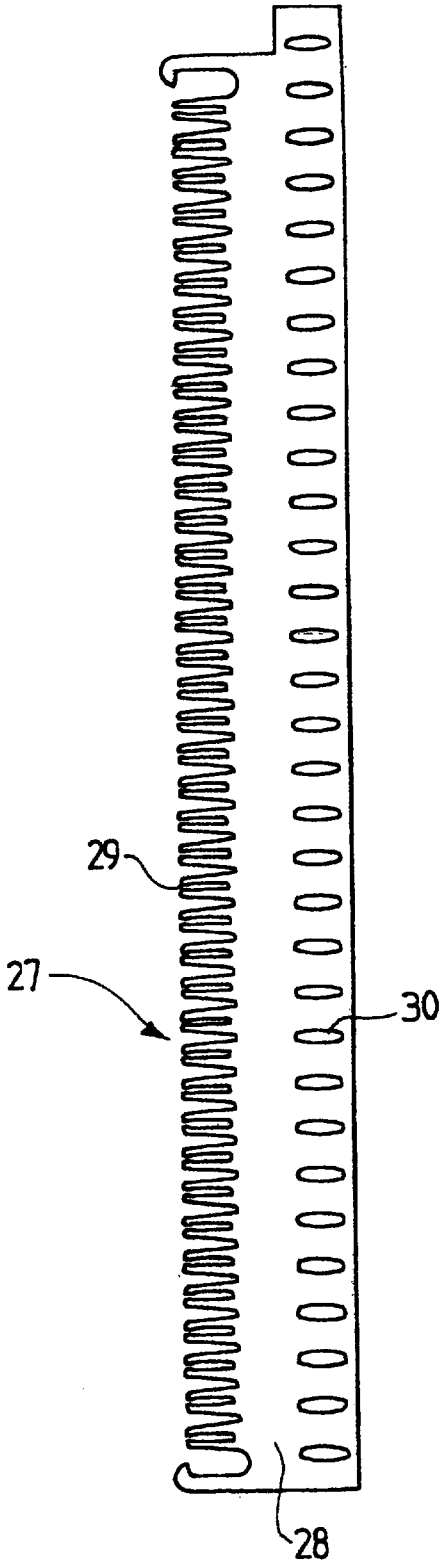
FIG. 5 is a side view of a comb-shaped component according to another embodiment.
Figure 6:
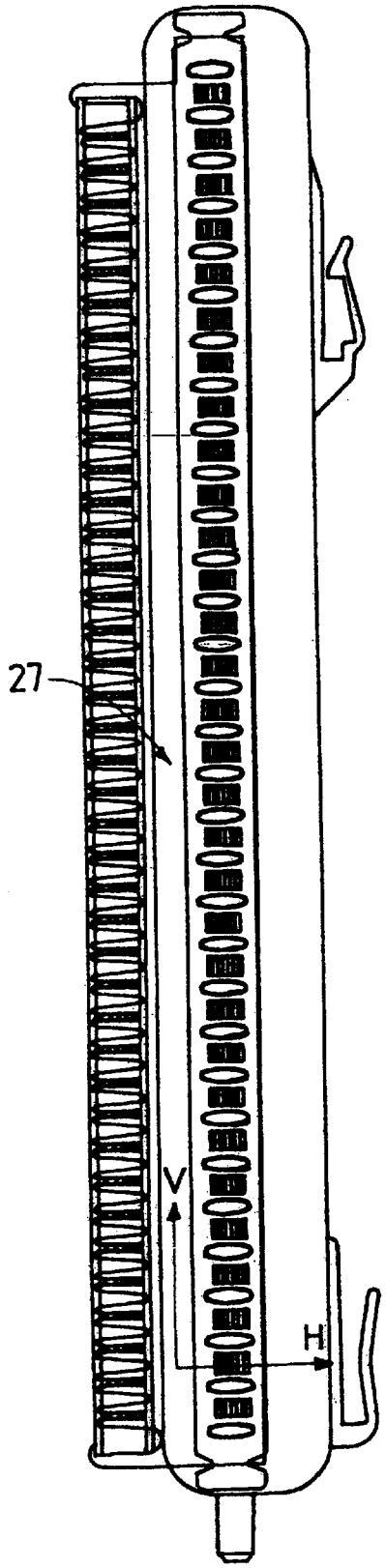
FIG. 6 is a side view of a heat-exchange module comprising at least one comb-shaped component according to FIG. 5.

Another embodiment is represented in FIGS. 5 and 6.

The comb-shaped component 27 (FIG. 5) still includes a solid central strip 28 but, although one of the longitudinal edges of this strip is still equipped with pairs of teeth 29 for clipping of the tubes of one of the heat exchangers, its other edge includes holes 30 of a shape and of dimensions corresponding to the tubes of the other heat exchanger. In the present case, the two exchangers (FIG. 6) are exchangers with a layer of flat tubes.

The heat-exchange module is then assembled by including the components 27 when producing the exchanger corresponding to the holes 30. The second exchanger is then clipped onto the teeth 29.

It will be observed that this embodiment allows for three heat exchangers to be assembled, by providing a second row of teeth on the other side of the holes 30, along the edge of the component 27 opposite the teeth 29.

Figure 7:
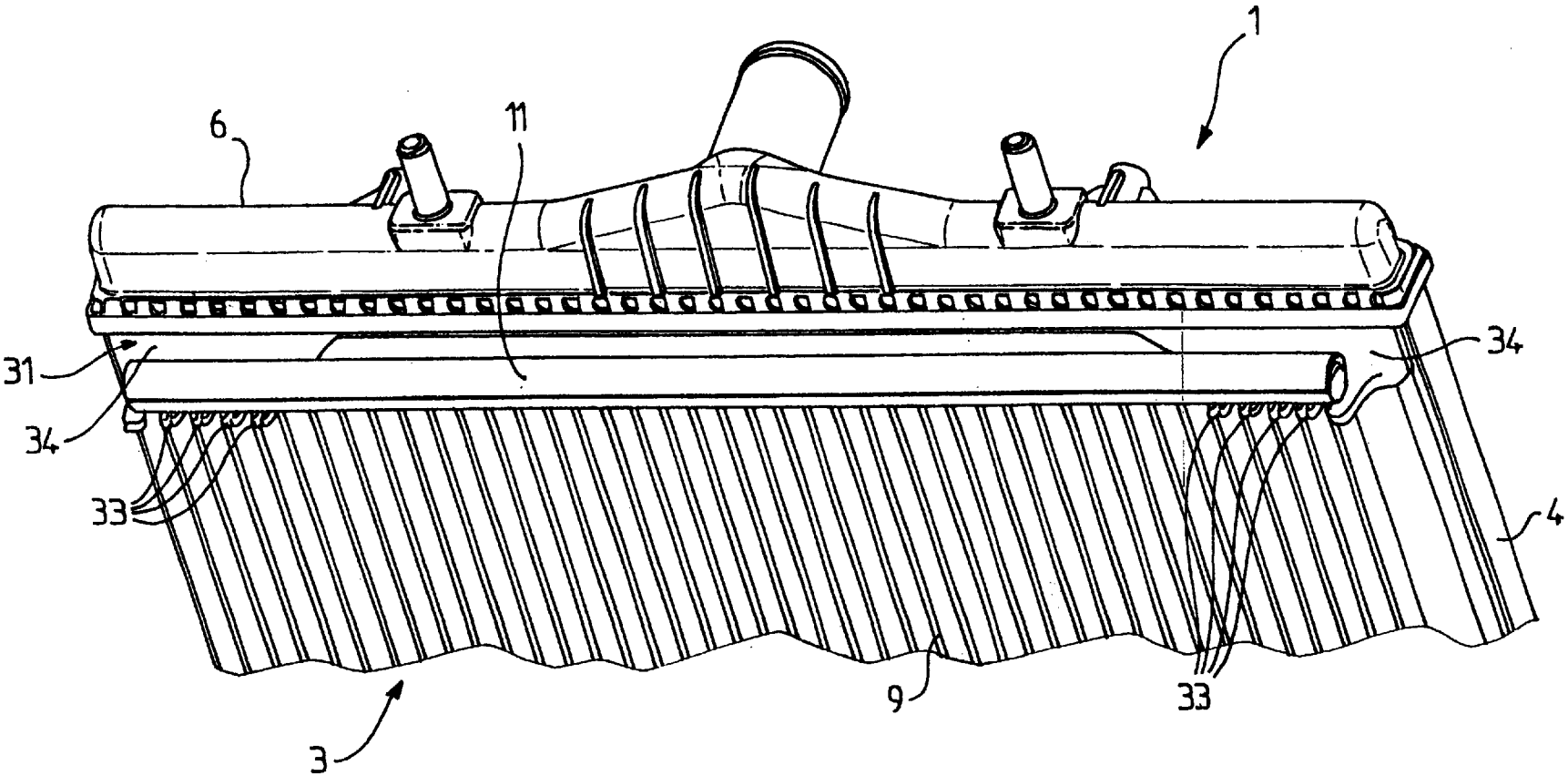
FIG. 7 is a partial view in perspective of two exchangers assembled in accordance with another embodiment.
Figure 8:
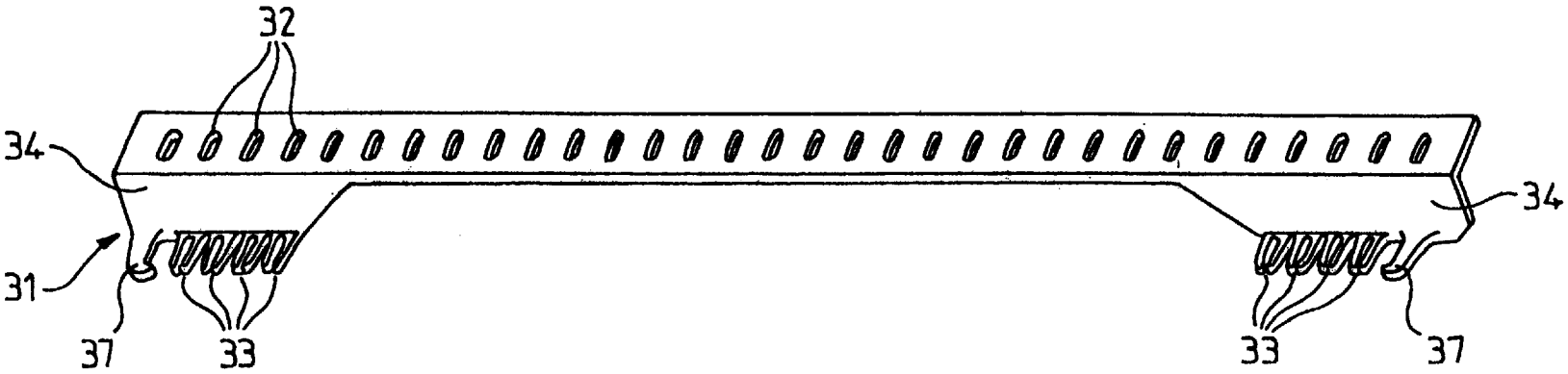
FIG. 8 is a view in perspective of a comb-shaped component used in the assembly of FIG. 7.

In FIGS. 7 and 8 will be seen the two exchangers 1 and 3, of different dimensions and assembled by the use of a comb-shaped component 31 including, as described previously, holes 32 for the tubes of the exchanger 1 to pass through and teeth 33 for accommodating the tubes of the exchanger 3.

In the present case, however, the comb-shaped component 31 includes a stepped feature 34 substantially perpendicular to the planes of the said component in which the holes 32 and the teeth 33 are formed, this step situated between the plane in which the holes 32 are formed and the plane in which the teeth 33 are formed, and which is therefore located, after fitting, substantially parallel to the planes of the exchangers 1 and 3.

The stepped feature 34 is produced here in two parts, at the ends of the comb-shaped component 31. The teeth 33 which are linked to this stepped feature, therefore feature only in these end parts.

Figure 9:
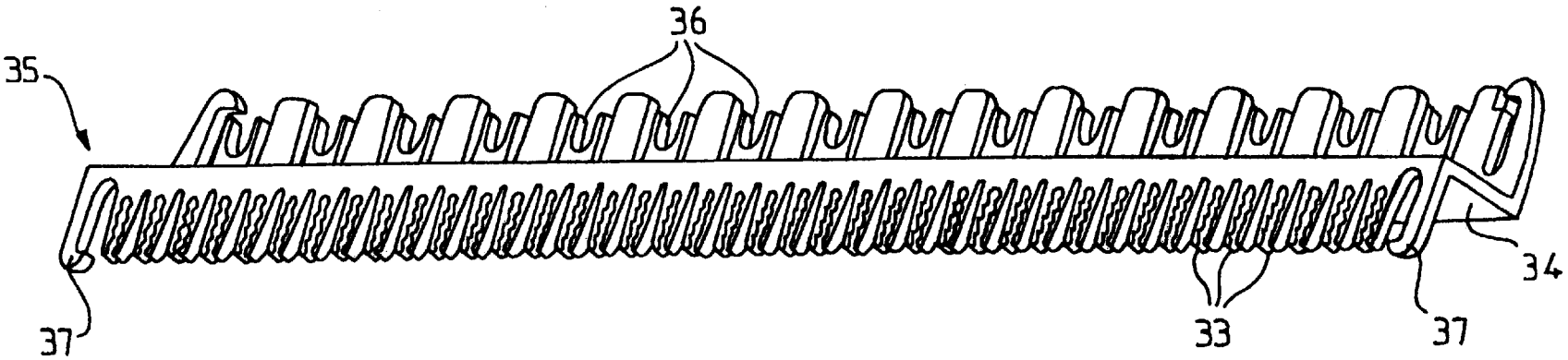
FIG. 9 is a view in perspective of a comb-shaped component according to another embodiment.

FIG. 9 shows a comb-shaped component 35 which is a variant embodiment of the comb-shaped component 31 of FIGS. 7 and 8. The same references have been used.

However, in this latter case, the stepped feature 34 extends over the entire length of the comb-shaped component 35, and, consequently, likewise for the teeth 33. Moreover, the holes for the tubes of the exchanger 1 to pass through have been replaced by teeth 36.

It will be observed that, in the case of the teeth, terminal hooks 37 are provided in the comb-shaped components 31 and 35, extending from the teeth 33, which make it possible to provide for or to reinforce the clipping of the comb-shaped component onto the respective exchanger.

The heat-exchange modules of FIGS. 7 to 9 may include one or two comb-shaped components such as those which have just been described, at one or each of their ends.

The presence of a stepped feature between the fitting means (teeth or holes) on the first exchanger and the teeth for clipping of the second exchanger make it possible to assemble two exchangers of different dimensions. Put another way, this stepped feature allows assembly of two exchangers, the respective bodies of which, that is to say their respective tubes, are of different lengths.

Needless to say, the stepped feature can be produced over the entire length of the comb-shaped component or only at the extremities thereof, whatever the type of fitting means (teeth or holes) used for assembling the first exchanger.

What we claim is:

1. A heat-exchange module comprising a main exchanger and at least one secondary exchanger, each including a body provided with fluid-circulation tubes and with a clipping device for fixing the secondary exchanger onto the main exchanger in such a way that the same airflow can pass through the respective bodies of the exchangers, wherein the clipping device comprises at least one comb-shaped component including:

a fitting device for fitting onto a first of the exchangers, and at least one first row of teeth exhibiting between them, pair by pair, a gap of a shape corresponding substantially to the cross section of the fluid-circulation tubes of the second of the exchangers, so as to clip the body of this second exchanger onto the comb-shaped component in order to fix it to the first exchanger.

2. The heat-exchange module of claim 1, in which the fitting device for fitting the comb-shaped component onto the first of the exchangers comprise a second row of teeth exhibiting between them, pair by pair, a gap of a shape corresponding substantially to the cross section of the fluid-circulation tubes of the first of the exchangers, so as to clip the comb-shaped component onto the body of the first exchanger.

3. The heat-exchange module of claim 1, in which the fitting device for fitting the comb-shaped component onto the first of the exchangers comprise a set of holes into which are engaged the fluid-circulation tubes of the first exchanger.

4. The heat-exchange module of claim 1, in which the comb-shaped component comprises a support strip and teeth substantially in the plane of the strip, the plane of this component lying substantially perpendicular to the planes of the bodies of the exchangers.

5. The heat-exchange module of claim 1, in which the comb-shaped component comprises a support strip and teeth in a plane substantially perpendicular to the plane of the strip, the plane of the strip lying substantially parallel to the planes of the bodies of the exchangers.

6. The heat-exchange module of claim 1, comprising at least two comb-shaped components, the components belonging to two sides of a fitting frame configured to accommodate the heat exchangers by means of the comb-shaped components.

7. The heat-exchange module of claim 1, in which the comb-shaped component comprises a support strip and teeth in a plane substantially perpendicular to the plane of the strip, the plane of the strip lying substantially parallel to the planes of the bodies of the exchangers, and comprising at least two comb-shaped components, the components belonging to two sides of a fitting frame configured to accommodate the said heat exchangers by means of the comb-shaped components, the module including a tubular frame with two comb-shaped components, the support strips of which are arranged inside the frame, along two opposite sides thereof, in a central part of these sides in the axial sense.

8. The heat-exchange module of claim 1, in which the comb-shaped component has a stepped feature, between the means for fitting onto the first exchanger and the first row of teeth.

9. The heat-exchange module of claim 8, in which the stepped feature extends over the entire length of the comb-shaped component.

10. The heat-exchange module of claim 8, in which the stepped feature extends only at the ends of the comb-shaped component.

11. The heat-exchange module of claim 8, in which the stepped feature is substantially parallel to the plane of the exchangers.

12. Method of producing a heat-exchange module comprising a main exchanger and at least one secondary exchanger, each including a body provided with fluid-circulation tubes, and a clipping device for fixing the secondary exchanger onto the main exchanger in such a way that the same airflow can pass through the respective bodies of the exchangers, the method including the following steps:

producing the exchangers, producing at least one comb-shaped component including a fitting device means for fitting onto a first of the exchangers, and at least one first row of teeth featuring between them, pair by pair, a gap of a shape corresponding substantially to the cross section of the fluid-circulation tubes of the second of the said exchangers, fitting the comb-shaped component onto the first exchanger, and clipping the body of the second exchanger onto the comb-shaped component.

13. The method of claim 12, in which the comb-shaped component is mounted on the first exchanger when the latter is being produced.

14. The method of claim 12, in which the comb-shaped component is clipped onto the body of the first exchanger after the latter has been produced.

* * * * *